US005579728A

United States Patent [19]

Gotmalm

[11] Patent Number: 5,579,728

[45] Date of Patent: Dec. 3, 1996

[54] VEHICLE WITH COMBINED COOLING SYSTEM AND HYDRAULIC SYSTEM

[75] Inventor: Christer T. Gotmalm, Sault Ste. Marie, Canada

[73] Assignee: Advanced Thermodynamics Corporation, Ontario, Canada

[21] Appl. No.: 540,252

[22] Filed: Oct. 6, 1995

[30] Foreign Application Priority Data

Oct. 6, 1994 [CA] Canada ..... 2133812

[51] Int. Cl.[6] ..... F01P 3/00

[52] U.S. Cl. ..... 123/41.55; 123/41.01

[58] Field of Search ..... 123/41.55, 41.01, 123/41.31, 41.29

[56] References Cited

U.S. PATENT DOCUMENTS

| | | | |
|---|---|---|---|
| 3,841,797 | 10/1974 | Fitzgerald | 123/46 R |
| 3,942,486 | 3/1976 | Kirchner | 123/41.02 |
| 4,425,879 | 1/1984 | Shadday et al. | 123/41.12 |

*Primary Examiner*—David A. Okonsky

*Attorney, Agent, or Firm*—Sughrue, Mion, Zinn, Macpeak & Seas

[57] ABSTRACT

There is described a method and apparatus for supplying power to ancillary equipment comprising a prime mover cooled by a liquid pump to pressurize the liquid, first conduit means for the flow of fluid pressurized by the pump means to the ancillary equipment for actuation thereof and second conduit means for the return flow of liquid to one or both of the prime mover and the pump.

21 Claims, 1 Drawing Sheet

VEHICLE WITH COMBINED COOLING SYSTEM AND HYDRAULIC SYSTEM

FIELD OF THE INVENTION

The present invention relates to auxiliary power systems and more particularly to systems providing auxiliary power hydraulically to ancillary equipment on a vehicle using the coolant of the vehicle's prime mover as the hydraulic media.

BACKGROUND OF THE INVENTION

Traditionally, heavy vehicles have been left idling when at rest to maintain power to ancillary equipment. Environmental regulations, including new anti-idling laws, now restrict this practice and many vehicles now carry a second smaller engine or auxiliary power unit (APU) to run the ancillary equipment when the vehicle's prime mover is shut down during rest stops or layovers.

Thus, systems are known in which an auxiliary engine mounted to the vehicle's frame serves the purpose of maintaining vital functions in the vehicle when the main engine is shut down. These vital functions include electrical generators, heating (preheating or maintaining heat) of the main engine electrically and/or by transfer of coolant from the APU to the main engine and other vehicle components, cooling of personal areas of the vehicle by means of electrically powered hermetically sealed air conditioners or air conditioners powered by means of transfer of a refrigerant from a compressor on the APU to an evaporator in the cab (split system air conditioner), and powering, directly or indirectly, hydraulic systems for linear or rotating motors.

These systems have several disadvantages. As the auxiliary engine must be mounted on the outside of the vehicle, the compressor, in case of a split air conditioning system, and the generator, both being attached to the engine, will be exposed to adverse weather conditions and salt spray and dirt from the road. This causes corrosion and in the case of the generator electric insulation problems which can cause electric shock. The transmission lines for refrigeration, in the case of a split system, must be opened for installation, vacuum pumped and charged with the refrigerant. These lines are prone to wear and leaks. This makes installation and repair expensive and it requires more refrigerant than a hermetically sealed system and increases the risk of refrigerant leaks to the environment. In the case of a generator, the power is transmitted through wires which, when subjected to wear and humidity, can cause shorts and shocks. In case of hydraulic systems, an oil tank is obviously required and these are costly, heavy and space consuming, and in some cases a hydraulic oil cooler with a separate radiator and fan system is also required. Hydraulic oil leaks contaminate the environment and create a fire hazard. Hydraulic oil is expensive.

SUMMARY OF THE INVENTION

The overall purpose of the invention is to provide heating, cooling, electrical power and/or mechanical power for linear or rotating motions to ancillary equipment on vehicles by means of hydrostatic transmissions and systems using the coolant from the vehicle's hydrodynamic cooling system as the hydraulic fluid. The result is a unique integrated hydrodynamic/hydrostatic system using a single fluid from a common source for both purposes.

The invention allows sensitive equipment such as generators and compressors to be sheltered inside the vehicle or in an enclosure remote from the prime mover or the auxiliary engine, thus protected from weather and dirt, as the transmission of power to the equipment is carried out hydraulically. The hydraulic fluid is the same fluid used for cooling the vehicle's prime mover. For vehicles operating in frost free environments, this fluid can be pure water. In most cases however, an anti-freeze/water mixture will be used. This fluid is considerably less dangerous and environmentally hazardous than conventional hydraulic oils. It is also cheaper and non-combustible.

Because the hydraulic fluid (water) can be drawn from the vehicle's cooling system, a dedicated hydraulic tank is not required and the vehicle's existing radiator and fan system can be used for cooling as the hydraulic fluid after use is returned to that system. This saves weight and space and cuts down on the parts count which will positively affect the demand for maintenance and repair as well as initial cost. During operation in cold climates, the efficiency losses in the hydraulic system ending up as heat can be utilized for preheating or maintaining heat in the vehicle's prime mover where the efficiency approaches 100%. A choker valve or fluid resistor can be used to additionally load the APU to increase its heat output. This additional heat can be used to elevate the temperature in the vehicle's main system to the point where the vehicle's "coolant to air heater" delivers a comfortable cab climate and/or the prime mover is preheated or heated to its correct working temperature.

The present system will most commonly involve two engines—the vehicle's prime mover and a smaller APU—with both sharing the same liquid coolant system (the coolant). The engines are connected by means of fixed or flexible lines. The flow direction in the lines should be that which best suits the installation and the components. Flow can be bi-directional by means of the use of suitable valves but will usually be uni-directional and in most cases the flow will be arranged in such a way that both engines can work simultaneously. It will be understood however that the present invention is not restricted to a specific flow direction or plumbing system.

The APU powers a water-hydraulic pump, such as the Danfoss Nessie*. This pump draws hydraulic fluid/coolant from the prime mover's cooling system, pressurizes it and delivers it to hydraulic motors, valves and actuators connected by means of flexible, rigid or belt drives to generators and refrigerant compressors etc. advantageously mounted inside the vehicle itself or within protective covers, and, if present, to rotating or linear hydraulic devices linked to loading and lifting equipment remote from the hydraulic pump. After performing the work, the hydraulic fluid is returned to the main engine's cooling system. An hydraulic resistor, which can be controlled manually or by a temperature sensor in the system's main cooling circuit, can be connected to the pump's pressure line or in any return line in such a way that this resistor transforms hydraulic power into heat in the coolant prior to dumping the coolant back into the main engine's system. The hydraulic circuit can also be directed, by means of valves and fixed fluid conduits, to different areas and devices of the vehicle prior to being returned to the main engine's cooling system in order to power loading ramps, cranes, cargo pumps and so forth.

*Trade-mark

According to the present invention, then, there is provided apparatus for supplying power to ancillary equipment comprising a prime mover cooled by a liquid, pump means to pressurize the liquid, first conduit means for the flow of fluid pressurized by the pump means to the ancillary equipment for actuation thereof, and second conduit means for the return flow of the liquid to one or both of the prime mover and the pump means.

According to another aspect of the present invention, there is also provided a method of supplying power to ancillary equipment, comprising the steps of providing a system including a reservoir of liquid for cooling of a prime mover, directing a flow of the liquid to pump means for pressurization of the liquid, directing the pressurized liquid to the ancillary equipment for actuation thereof, and returning the fluid to one or both of the system and the pump means.

The invention is not restricted to two-engine vehicles only. Any number of combustion engines on the same vehicle can utilize the invention.

It will be understood as well that "vehicle" is used in the broadest sense to include all manner of transport such as trucks, boats, trains, mobile cranes, barges, airplanes, earthmovers and so forth without limit. It is expected as well that the invention will find application in connection with stationary installations.

BRIEF DESCRIPTION OF THE DRAWINGS

Preferred embodiments of the present invention will now be described in greater detail and will be better understood when read in conjunction with the following drawing, in which.

DETAILED DESCRIPTION

Figure 1:
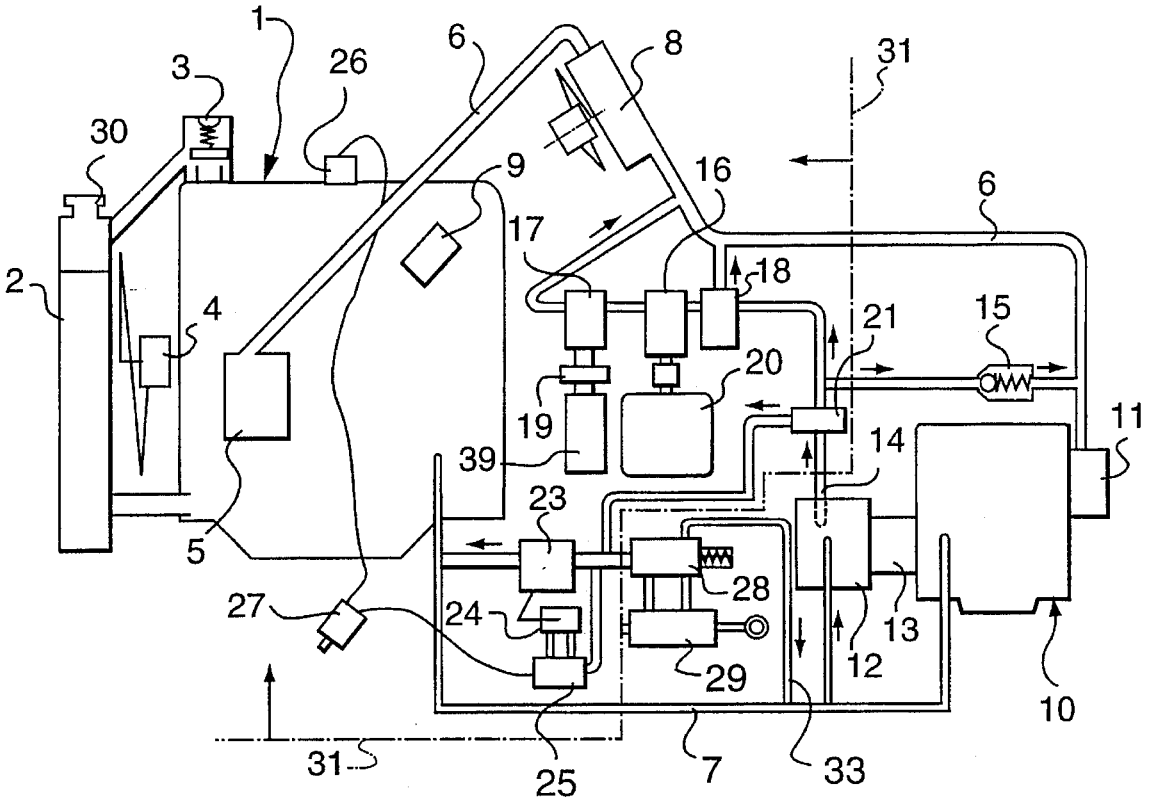
FIG. 1 is a schematical representation of the auxiliary power system in accordance with the present invention.

With reference to FIG. 1, there is shown the vehicle's main engine or prime mover 1 which in many territories for environmental, operational and economic reasons cannot be left running to provide heat, air conditioning, electric, hydraulic or mechanical power to the driver or the vehicle's ancillary equipment during stops. Engine 1 includes a radiator 2, a thermostat 3, and a fan 4 in the conventional manner. The fan can be directly, belt or electrically driven with or without a clutch. By driving it electrically or hydraulically, the fan can be used to cool the system's coolant when the main engine is shut down. An engine-driven coolant circulation pump 5 circulates coolant through the main engine block 1, and via the coolant lines 6 and 7 and the blower assisted cab heater 8 to an auxiliary power unit 10 when the prime mover is running. The engine block can have an electrically powered block heater 9. Power to this heater can come from shore power or the vehicle's generator 20. APU 10 has its own circulation pump 11 which circulates coolant via lines 6 and 7 and the heater 8 to main engine 1. This way, either or both of the engines can run and circulate coolant for preheating and standby heating of both engines, utilizing waste heat from the combustion process. The APU has a load compensating control of conventional type to compensate for variations to its load. APU 10 powers a hydraulic pump 12, of such type that it can work with water or a water/antifreeze mixture as the hydraulic fluid. One such commercially available pump is the Danfoss Nessie. Pump 12 can be direct or belt driven and can have a clutch 13. The pressure line 14 from pump 12 can be connected to a pressure relief valve (safety valve) 15, which opens at overpressure to dump the hydraulic fluid back into the main cooling system. Pressure line 14 is shown as being split to direct hydraulic fluid to hydraulic motors 16 and 17 via a valve 18. Valve 18 can be an on/off type for dumping fluid back into the system when in the off position, and/or a constant flow type for maintaining motor 16 at a uniform speed so that connected generator 20 delivers a constant voltage or constant frequency or both. Alternatively, motors 16 and 17 can be of a constant rpm type with manual or automatic displacement regulation. Motor 17 drives an air conditioning compressor 39 via a belt, fixed coupling or temperature or pressure regulated clutch 19.

Motors 16 and 17 are shown connected in series but could alternatively be connected in parallel.

A diverter valve 21 allows part of or all of the flow from hydrostatic pump 12 to be directed to a choker valve 23 which can be either manually or electrically controlled or, as shown in FIG. 1, by means of an hydraulic cylinder 24 having an electrically powered valve 25 receiving signals from a temperature sensor 26 placed in the cooling circuit. The purpose of the choker valve is to create resistance, friction and/or turbulence to transform hydrostatic power into heat in the coolant and also to increase the load on APU 10 in order to create more waste heat. The operation of the choker valve is controlled and determined by the temperature in the coolant which is monitored by sensor 26.

With choker valve 23 closed such as by means of an override switch 27, the hydraulic flow from diverter valve 21 is directed to an hydraulic valve bank 28 which regulates flow to one or more hydraulic cylinders, motors or actuators 29 used, for example, to actuate tailgates, loading ramps, cranes or other power equipment. The return fluid is dumped back into the main cooling system via return line 33. In the event that single ram or single stroke hydraulic cylinders are connected into the system, a make up tank and breather cap 30 will absorb any surge in the coolant/hydraulic system.

Environmentally sensitive components of the present system are shown placed within a protective enclosure 31.

As will be appreciated from the foregoing by those skilled in the art, the present system permits the integration of what previously have been two entirely separate systems, namely a hydrodynamic one characterized by high flow rates and low pressures exemplified by cooling systems, and a hydrostatic one characterized by low flow rates and high pressures exemplified by hydraulic equipment. The integration permits the use of a single fluid for both systems advantageously drawn from a single source which further facilitates elimination of redundancies in fluid storage, cooling and plumbing.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. Apparatus for supplying power to ancillary equipment comprising:

a prime mover cooled by a liquid;

pump means to pressurize said liquid;

first conduit means for the flow of fluid pressurized by said pump means to said ancillary equipment for actuation thereof; and second conduit means for the return flow of said liquid to one or both of said prime mover and said pump means.

2. The apparatus of claim 1 wherein said pump means comprise a hydraulic pump and an auxiliary power unit for actuation of said pump.

3. The apparatus of claim 2 including flow regulating means in said conduit means, said flow regulating means being selectably adjustable to restrict the return flow of said liquid to said prime mover to increase the temperature of said liquid and to increase loading of said auxiliary power unit.

4. The apparatus of claim 3 wherein said second conduit means comprise a plurality of flow paths for the return of said liquid to said prime mover and said pump means.

5. The apparatus of claim 4 wherein said auxiliary power unit is cooled by at least a portion of said liquid.

6. The apparatus of claim 5 wherein one of said plurality of paths includes a flow line from said auxiliary power unit to said prime mover.

7. The apparatus of claim 6 wherein one of said plurality of paths include said flow regulating means therein.

8. The apparatus of claim 7 further including switch means actuatable to selectively close said flow regulating means for diverting the flow of said liquid towards one or both of said ancillary equipment and another of said plurality of flow paths.

9. The apparatus of claim 8 including a reservoir for said liquid.

10. The apparatus of claim 9 wherein said ancillary equipment includes one or more of apparatus for heating, cooling, generating electricity or performing work.

11. The apparatus of claim 10 wherein said prime mover is the engine of a vehicle.

12. The apparatus of claim 11 wherein said auxiliary power unit is an internal combustion engine.

13. The apparatus of claim 1 wherein said auxiliary power unit is operable independently of said prime mover.

14. A method of supplying power to ancillary equipment, comprising the steps of:

providing a system including a reservoir of liquid for cooling of a prime mover;

directing a flow of said liquid to pump means for pressurization of said liquid;

directing said pressurized liquid to said ancillary equipment for actuation thereof; and returning said fluid to one or both of said system and said pump means.

15. The method of claim 14 wherein at least a portion of said liquid is used to cool said pump means prior to the return of said portion to said system.

16. The method of claim 15 including the step of establishing multiple flow paths for the return of said liquid to one or both of said system and said pump means.

17. The method of claim 16 wherein flow restrictor means are disposed in at least one of said multiple flow paths, said resistor means being selectively adjustable to impede the return flow of at least a portion of said liquid to said prime mover whereby the temperature of said liquid and the load on said pump means can be correspondingly adjusted.

18. The method of claim 17 wherein said pump means are operable independently of said prime mover.

19. The method of claim 18 wherein said ancillary equipment includes one or more of apparatus for heating, cooling, generating electricity or performing work.

20. The method of claim 15 wherein said pump means comprise an hydraulic pump and an auxiliary power unit to actuate said pump.

21. The method of claim 20 wherein heat from said auxiliary power unit is used to heat said prime mover.

* * * * *